US009142889B2

(12) United States Patent
Pazin et al.

(10) Patent No.: US 9,142,889 B2
(45) Date of Patent: Sep. 22, 2015

(54) COMPACT TAPERED SLOT ANTENNA

(75) Inventors: Lev Pazin, Haifa (IL); Yehuda Leviatan, Haifa (IL)

(73) Assignee: TECHNION RESEARCH & DEVELOPMENT FOUNDATION LTD., Senate House Technion, Haifa (IL)

( * ) Notice: Subject to any disclaimer, the term of this patent is extended or adjusted under 35 U.S.C. 154(b) by 244 days.

(21) Appl. No.: 13/511,655

(22) PCT Filed: Feb. 2, 2011

(86) PCT No.: PCT/IL2011/000120
§ 371 (c)(1),
(2), (4) Date: May 24, 2012

(87) PCT Pub. No.: WO2011/095969
PCT Pub. Date: Aug. 11, 2011

(65) Prior Publication Data

US 2012/0313832 A1 Dec. 13, 2012

Related U.S. Application Data

(60) Provisional application No. 61/300,457, filed on Feb. 2, 2010.

(51) Int. Cl.
*H01Q 13/10* (2006.01)
*H01P 5/02* (2006.01)

(52) U.S. Cl.
CPC ..... *H01Q 13/106* (2013.01); *H01P 5/028* (2013.01)

(58) Field of Classification Search
CPC ..... H01Q 13/106; H01P 5/028
USPC ..... 343/767
See application file for complete search history.

(56) References Cited

U.S. PATENT DOCUMENTS

| | | | | |
|---|---|---|---|---|
| 3,836,976 | A | 9/1974 | Monser et al. | |
| 4,500,887 | A | 2/1985 | Nester | |
| 4,636,753 | A * | 1/1987 | Geller et al. | 333/26 |
| 4,636,757 | A * | 1/1987 | Harrison et al. | 333/218 |

(Continued)

OTHER PUBLICATIONS

PCT Int'L Search Report and Written Opinion of the ISA, mailed Jun. 27, 2011 in PCT/IL11/00120.

(Continued)

*Primary Examiner* — Hoang V Nguyen
*Assistant Examiner* — Michael Bouizza
(74) *Attorney, Agent, or Firm* — Daniel J. Swirsky; AlphaPatent Associates Ltd.

(57) ABSTRACT

A compact endfire tapered slot antenna, which may be advantageously printed on a low permittivity Liquid Crystal Polymer substrate. The antenna features a microstrip-to-slot transition, in which the matching stubs of the slotline antenna feed and the microstrip input line are collinear. This is achieved using a 90° bend in the slotline. The antenna is consequently of smaller size, and has improved bandwidth over prior art geometries. The antenna may be carried on a fork-shaped metallic carrier, which gives it good rigidity, and may incorporate a metallic reflector, which increases its directive gain. The antenna is simpler to manufacture and a less costly alternative to conventional 60-GHz tapered slot antennas printed on multilayer LTCC substrates. It can be used both as an individual radiator as well as an element of an antenna array and is readily integrated with an RF module for use in future WPAN applications.

20 Claims, 7 Drawing Sheets

(56) References Cited

U.S. PATENT DOCUMENTS

| | | | | |
|---|---|---|---|---|
| 4,853,704 | A | 8/1989 | Diaz et al. | |
| 5,036,335 | A | 7/1991 | Jairam | |
| 5,175,560 | A | 12/1992 | Lucas et al. | |
| 5,442,367 | A * | 8/1995 | Naito et al. | 343/700 MS |
| 5,519,408 | A | 5/1996 | Schnetzer | |
| 6,043,785 | A | 3/2000 | Marino | |
| 6,075,493 | A | 6/2000 | Sugawara et al. | |
| 6,239,761 | B1 | 5/2001 | Guo et al. | |
| 6,317,094 | B1 | 11/2001 | Wu et al. | |
| 6,791,438 | B2 * | 9/2004 | Takahashi et al. | 333/208 |
| 7,486,247 | B2 * | 2/2009 | Ridgway et al. | 343/767 |
| 2002/0024474 | A1 | 2/2002 | Chen | |

OTHER PUBLICATIONS

"A Compact Conformal End-Fire Antenna for 60 GHz Wireless Applications," by A.L. Amadjikpe et al, published in IEEE Antennas Propag. Soc. Int. Symp. Dig., Jun. 2009, pp. 1-4.

"An integrated wideband circularly-polarized 60 GHz array antenna with low axial-ratio," by J.S. Kot, et al, in Proc. 2nd Int. Wireless Broadband Ultra-Wideband Commun. Conf., Sydney, Australia, Aug. 2007.

"Study of a 60 GHz rectangular patch antenna on a flexible LCP substrate for mobile applications," by L. Amadjikpe in IEEE Antennas Propag. Soc. Int. Symp. Dig., San Diego, CA, Jul. 2008, pp. 1-4.

"3-D integrated RF and millimeter-wave functions and modules using liquid crystal polymer (LCP) system-on-package technology," by M.M. Tentzeris et al, published in IEEE Trans. Adv. Packag., vol. 27, No. 2, pp. 332-340, May 2004.

"Linear tapered cavity-backed slot antenna for millimeter-wave LTCC modules" by I.K. Kim et al, published in IEEE Antennas Wireless Propag. Lett., vol. 5, pp. 175-178, 2006.

"Characterization of liquid crystal polymer LCP material and transmission lines on LCP substrates from 30 to 110 GHz," by D.C. Thompson et al, IEEE Trans. Microw. Theory Tech., vol. 52, No. 4, pp. 1343-1352, Apr. 2004.

"Conformal double exponentially tapered slot antennas (DETSA) on LCP for UWB application," by S. Nikolaou et al, IEEE Trans. Antennas Propag., vol. 54, No. 6, pp. 1663-1669, Jun. 2006.

"Compact printed monopole antenna on liquid crystal polymer (LCP) for EWB applications," by X.R. Yan et al, in Proc. Int. Microw. Millitn.-Wave Conf., Nanjing, China, 2008, vol. 3, pp. 1080-1082.

"Use of the 57-64 GHz frequency band for point-to-point fixed wireless systems," ECC Recommendation, Jan. 2009.

"Circuit and module challenges for 60 GHz Gb/s radio," by J. Laskar et al, in Proc. 2005 IEEE/ACES Int. Wireless Commun. Appl. Comput. Electromagn. Conf., Honolulu, HI, 2005, pp. 447-450.

"Exploiting the 60 GHz band for local wireless multimedia access: Prospects and future directions," by P. Smulders, IEEE Commun. Mag., vol. 40, No. 1, pp. 140-147, Jan. 2002.

"Slot-line transitions," by J.B. Knorr, IEEE Trans. Microw. Theory Tech., vol. MTT-22, No. 5, pp. 548-554, May 1974.

* cited by examiner

COMPACT TAPERED SLOT ANTENNA

CROSS-REFERENCE TO RELATED APPLICATIONS

This application is a U.S. National Phase Application under 35 U.S.C. 371 of PCT International Application No. PCT/IL2011/000120, which has an international filing date of Feb. 2, 2011, and which claims the benefit of priority of U.S. Provisional Patent Application No. 61/300,457, filed Feb. 2, 2010, which is incorporated herein by reference.

FIELD OF THE INVENTION

The present invention relates to the field of tapered slot RF and microwave antennas, especially for use in broadband millimeter wave applications.

BACKGROUND OF THE INVENTION

The development of new wireless communication systems in the microwave and millimeter-wave bands have spurred the design of new types of compact, wideband, efficient, and low-cost antennas and antenna arrays. Among these, antennas manufactured by printed circuit technology have been increasingly widely used, because they are compact and low-cost. The tapered slot antenna (hereinafter TSA) is one such example, which has become an accepted and popular low cost antenna over the last three decades.

One typical example of such a TSA is shown in FIG. 1, described as prior art in U.S. Pat. No. 5,036,335 to H. L. Jairam for "Tapered Slot Antenna with Balun Slot Line and Stripline Feed". FIG. 1 shows an exponentially tapered slot (Vivaldi) antenna 10 defined by a metalized layer 15 on one main face of a substrate 14. The antenna 10 has a conventional feed arrangement comprising a microstrip defined by a narrow conductor 11 located on the reverse face of the substrate 14 to that of the tapered slot, and a slotline 13 extending from the narrower end of the slot antenna 10, formed orthogonally to the microstrip. The microstrip and slotline cross each other at right angles, forming an impedance matching balun 18, which is hereinafter known as the microstrip-to-slot transition area, or MST. The microstrip 11 terminates in an open-circuit and extends beyond the slotline 13 by a distance $\lambda_m/4$, where $\lambda_m$ is the guide wavelength in the microstrip 11 at the operating frequency of the antenna. The slotline 13 terminates in a short circuit through to the metalized layer 15, extending beyond the microstrip 11 by a distance $\lambda_s/4$, where $\lambda_s$ is the guide wavelength in the slotline 11 at the operating frequency of the antenna. Thus, at the cross-over point, the microstrip 11 is effectively short-circuited and the slotline 13 is effectively open-circuited. This form of MST has an inherent narrow bandwidth characteristic, such that the use of the antenna may be limited.

In these antennas, the choice of the substrate material may greatly affect the antenna efficiency. Previously used low temperature co-fired ceramic construction is costly, both from the substrate cost aspect, and from the fabrication costs because of the multilayer process. Liquid crystal polymer (LCP) substrates, with their mechanical flexibility and low permittivity, have been increasingly used for integrated RF and millimeter-wave functions and modules, such as described in the article "3-D-integrated RF and millimeter-wave functions and modules using liquid crystal polymer (LCP) system-on-package technology," by M. M. Tentzeris et al, published in IEEE Trans. Adv. Packag., vol. 27, no. 2, pp. 332-340, May 2004.

In the 60 GHz band, it is substantially more difficult to achieve wide bandwidths. Some examples of such antennas include wideband 60-GHz annular slot antennas, as described by J. S. Kot, et al, in the article "An integrated wideband circularly-polarized 60 GHz array antenna with low axial-ratio," in Proc. 2nd Int. Wireless Broadband Ultra-Wideband Commun. Conf., Sydney, Australia, August 2007, and narrowband rectangular patch antennas operating in the 59-61 GHz frequency range as described by L. Amadjikpe, et al, in "Study of a 60 GHz rectangular patch antenna on a flexible LCP substrate for mobile applications," in IEEE Antennas Propag. Soc. Int. Symp. Dig., San Diego, Calif., July 2008, pp. 1-4. Another 60-GHz antenna, of the linearly tapered slot type, with a wider bandwidth (5.6 GHz around 62 GHz) has also been recently proposed in the article entitled "A compact conformal end-fire antenna for 60 GHz applications," by L. Amadjikpe et al, published in IEEE Antennas Propag. Soc. Int. Symp. Dig., June 2009, pp. 1-4. A schematic rendering of such a TSA 20 is shown in FIG. 2, where the orthogonal crossing in the MST 22 is shown. Instead of the $\lambda_m/4$ open-circuited stub to provide the maximum field at the cross-over, as shown in the example of FIG. 1, in this implementation, a circle-shaped stub 24 is provided for wider bandwidth characteristics. The other details of the antenna are labeled with the same reference characters as those of FIG. 1. U.S. Pat. No. 6,075,493 to S. Sugawara et al also describes a 60 GHz. TSA.

However, there still exists a need for a compact, wideband TSA construction which overcomes at least some of the disadvantages of prior art antennas.

The disclosures of each of the publications mentioned in this section and in other sections of the specification, are hereby incorporated by reference, each in its entirety.

SUMMARY OF THE INVENTION

The present disclosure describes a new exemplary compact broadband end-fire Tapered Slot Antenna. Unlike prior art TSAs which use a generally orthogonal microstrip-to-slot transition between the microstrip feed line and the tapered slot, the antenna of the present disclosure features collinear stubs. This new transition provides a relatively wide frequency bandwidth. This transition also occupies less surface area than prior art transitions, making it more suitable for portable electronic devices. In addition, the antenna may advantageously be supported on a metallic fork-shaped carrier, which gives the antenna good rigidity, and may also incorporate a metallic reflector, which increases the antenna's directive gain. Such a reflector may also serve to reduce the possible effects of other components or elements of the RF module on the antenna. The antenna may be manufactured by printing on a suitable dielectric substrate, especially a thin liquid crystal polymer (LCP) substrate, with the advantages which such substrates provide. The performance of different examples of tapered slot antennas constructed as described in this application, can be simulated by use of an RF 3D EM field simulation and circuit design program. The TSA can be used for any frequency band, including the band from 56 GHz up to 66 GHz., incorporating the partial operating bands for WPAN application, namely 57-64, 59-62, 62-63, and 65-66 GHz. allocated in various countries for high-speed data rate wireless communications.

This application relates throughout to the TSA as a transmitting antenna, as is customary when describing such end-fire antennas, referring generally to the microstrip input feed. However, it is to be understood that these antennas may equally be used for reception, and the invention is not intended generally to be limited to either one of transmission or reception, nor are the claims intended to be so interpreted. Furthermore, although the term microstrip is strictly meant to refer to a narrow conductor together with the dielectric substrate on which it is deposited, in common parlance it is used to denote the conductor alone, and this terminology may have been used at times in this disclosure.

One exemplary implementation involves a tapered slot antenna, comprising:

(i) a dielectric substrate having a thin conductive layer on a first face, a tapered slot being formed in the conductive layer, the tapered slot having a narrow end and a broad end, (ii) a non-tapered slotline forming an extension of the narrow end of the tapered slot, and (iii) a microstrip conductor carried on a second face of the substrate, wherein the paths of the slotline and the microstrip intersect, and are collinear over at least a part of their length beyond the location on the substrate where the paths intersect.

Other implementations may further involve a tapered slot antenna as described above, wherein the non-tapered slotline continues beyond the intersection for a distance of essentially a quarter guided wavelength in the non-tapered slotline of the average frequency for which the antenna is intended, and the microstrip conductor continues beyond the intersection for a distance of essentially a quarter guided wavelength in the microstrip of the average frequency for which the antenna is intended. In any of these implementations, the slotline should be terminated by a short-circuit, and the microstrip conductor should be terminated by an open-circuit.

Furthermore, in any of the above-described antennas, the paths of the slotline and the microstrip conductor may intersect at right angles. The paths of the slotline and the microstrip conductor should be collinear over at least a part of their length beyond the intersection, either by virtue of a right angle bend in the path of the slotline, or by virtue of a right angle bend in the path of the microstrip conductor.

In any of the previously described antennas, the dielectric substrate may comprise a liquid crystal polymer material. Additionally, the dielectric substrate may be carried on a fork-shaped carrier, providing rigidity to the antenna. The antenna may further comprise a metallic reflector mounted perpendicular to the dielectric substrate at an end opposite to that of the broad end of the tapered slot. Furthermore, the microstrip conductor may be adapted to couple a signal port to the antenna.

Yet another implementation may involve a tapered slot antenna comprising:

(i) a dielectric substrate having a thin conductor on one surface, in which a tapered slot pattern is formed as a result of the progressive widening of the slot width of a slotline, and (ii) a microstrip conductor carried on a second face of the insulating substrate, the microstrip conductor intersecting the slotline at a position where the slotline is not widened, wherein a section of the non-widened portion of the slotline and a section of the microstrip conductor are disposed collinearly but on opposite sides of the substrate.

In such a tapered slot antenna, the non-widened slotline may continue beyond the intersection for a distance of essentially a quarter guided wavelength in the non-widened slotline of the average frequency for which the antenna is intended, and the microstrip conductor continues beyond the intersection for a distance of essentially a quarter guided wavelength in the microstrip of the average frequency for which the antenna is intended. In any of these implementations, the non-widened slotline should be terminated by a short-circuit, and the microstrip conductor should be terminated by an open-circuit.

The paths of the slotline and the microstrip conductor should be collinear over at least a part of their length beyond the intersection, either by virtue of a right angle bend in the path of the slotline, or by virtue of a right angle bend in the path of the microstrip conductor.

In any of these previously described antennas, the dielectric substrate may comprise a liquid crystal polymer material. Additionally, the dielectric substrate may be carried on a fork-shaped carrier, providing rigidity to the antenna. The antenna may further comprise a metallic reflector mounted perpendicular to the dielectric substrate at an end opposite to that of the broad end of the tapered slot. Finally, the microstrip conductor may be adapted to couple a signal port to the antenna.

BRIEF DESCRIPTION OF THE DRAWINGS

The presently claimed invention will be understood and appreciated more fully from the following detailed description, taken in conjunction with the drawings in which:

FIG. 6A shows the response characteristics of a TSA antenna constructed according to the details shown in FIGS. 3 to 5, while

DETAILED DESCRIPTION

Figure 1:
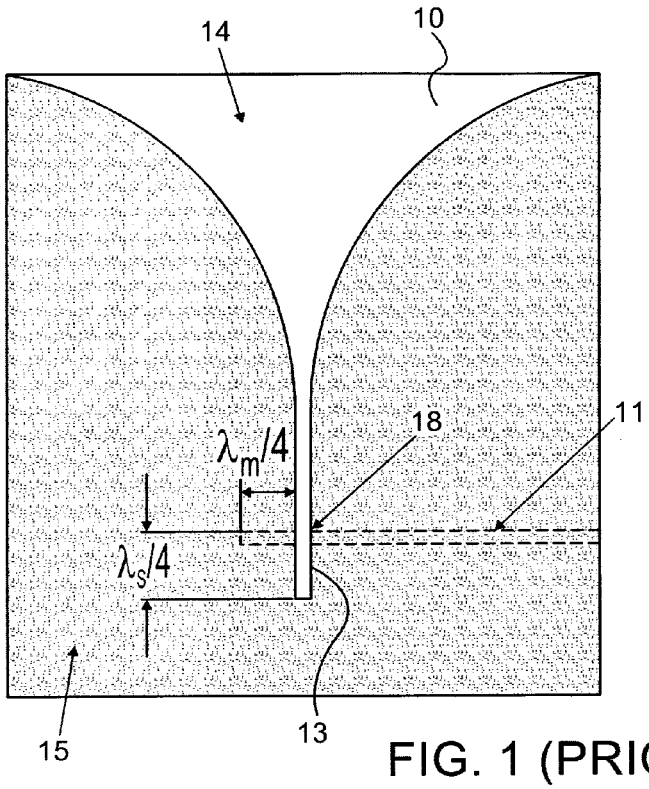
FIG. 1 (PRIOR ART)
FIG. 1 shows schematically a prior art exponentially tapered slot antenna with orthogonal stubs in the MST.
Figure 2:
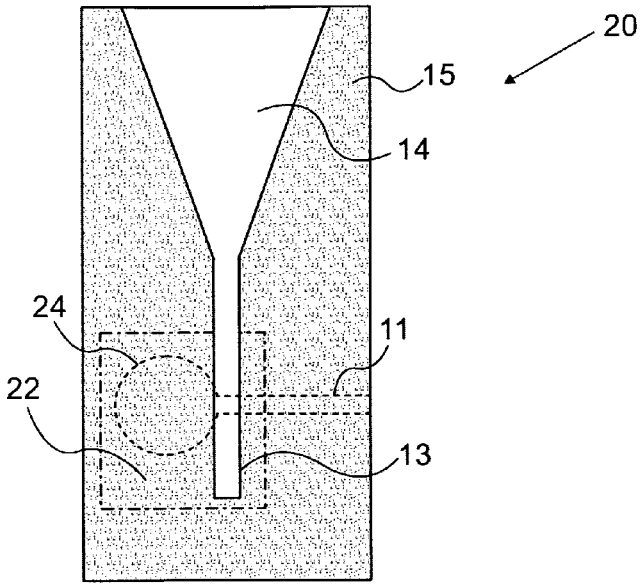
FIG. 2 (PRIOR ART)
FIG. 2 shows schematically a prior art linearly tapered slot printed antenna with circular-shaped microstrip stub.
Figure 3A:
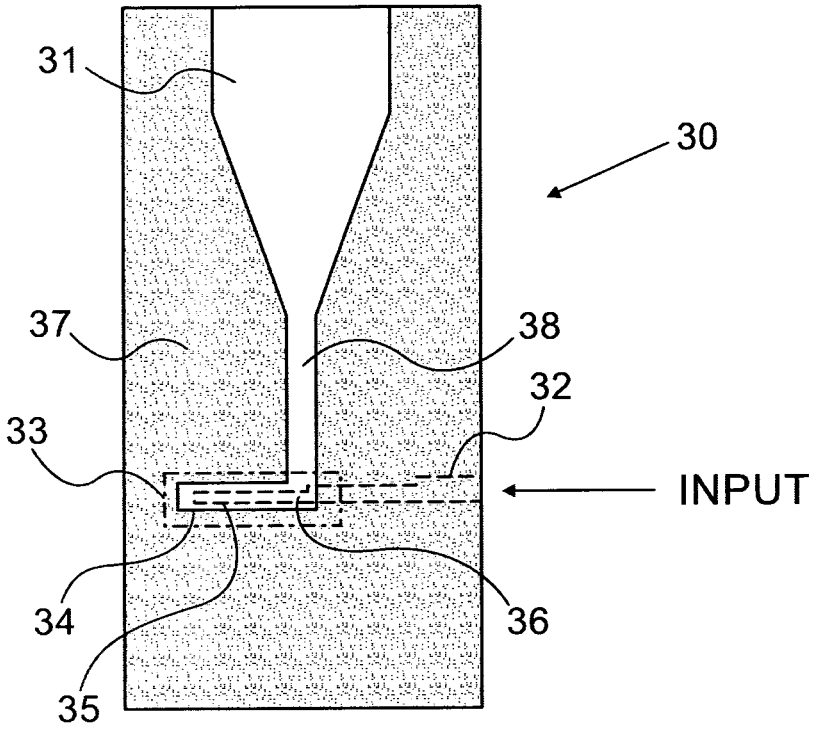
FIGS. 3A to 3C illustrate schematically alternative geometries of exemplary TSAs of the type described in this application.

Reference is now made to FIG. 3A, which illustrates schematically the geometry of an exemplary linearly-tapered Tapered Slot Antenna (TSA) 30 of the novel type described in this application. The tapered slot radiating element 31, which guides the electromagnetic waves into free space to generate the end-fire radiation, is formed by etching away metal from one side, the ground plane side 37, of a piece of rectangular shaped laminated substrate. This material may advantageously be, for example, a 0.1-mm-thick LCP substrate plated on both sides with 0.018-mm-thick copper layers. The 60 GHz band example shown was constructed on a 9.2 mm×4.5 mm rectangle-shaped piece of Rogers ULTRALAM 3850, 0.1-mm-thick LCP substrate ($\epsilon_r$=2.9, tgδ=0.0025).

The antenna may be fed by a 50Ω microstrip line whose conductor 32 is formed on the opposite side of the substrate to the slot line, known as the feed side. This is shown dashed in FIG. 3A to indicate that it is on the opposite surface. The steps in the feed microstrip line are for impedance matching. However, in contrast to prior art TSAs which incorporate an orthogonal crossing of the microstrip feed and the slot line, the TSAs described herein incorporate an MST region 33 between the input microstrip feed system and slot radiating system which comprises a short-circuited slot stub section 34 and an open-circuited microstrip stub segment 35 laid collinearly and at least partially overlapping each other. This is achieved most readily by introducing a right angle bend 36 in the slot line 38, so that the slot line stub 34 lies collinearly with the microstrip stub 35. This novel collinear microstrip-to-slot transition facilitates a wider bandwidth of operation, and is of more compact construction than prior art TSAs, making it eminently suitable for use in portable electronic devices. The bandwidth is generally sufficient for use in WPAN applications.

Figure 3B:
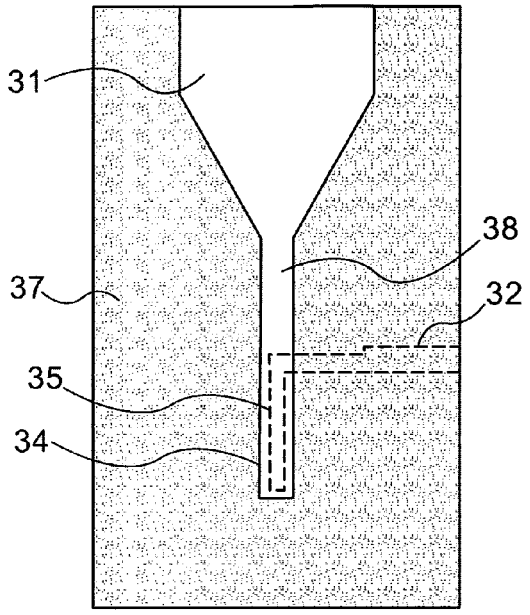
Figure 3C:
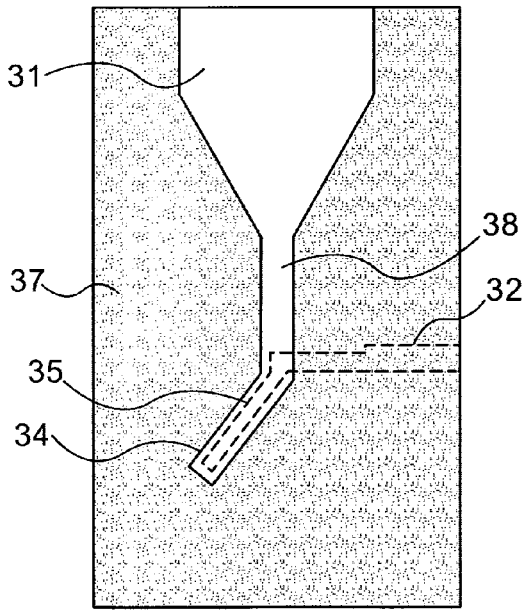

Reference is now made to FIGS. 3B and 3C, which illustrate schematically alternative implementations of the TSA shown in FIG. 3A. In FIG. 3B, the right angle bend is formed in the microstrip 35, rather than in the slot line 38, so that the microstrip feed stub 35 lies collinearly with the slotline stub 34. This implementation takes up more substrate area than that of FIG. 3A, but it may be useful in some situations. In FIG. 3C, both the microstrip feed stub 35 and the slotline stub 34 have bends to make them collinear. The bend angle is shown in FIG. 3C as 45°, though the angle need not necessarily be such.

One possible explanation of the increased bandwidth of the TSAs of the present disclosure could be that unlike the prior art, where coupling takes place at a small crossover area, relying on maximization of the fields at the crossover because of its distance from the stub terminations, in the present TSAs, the overlapping stubs provide substantial additional interaction area for the EM fields in the stubs to couple. The coupling along the overlapping lengths of stubs may result in the coupling of more propagation modes than is possible with the prior art orthogonal overlap, resulting in higher coupling efficiency. In addition, the multiplicity of coupled modes may generate less dependence on frequency, and hence better impedance matching. However, it is to be emphasized that the current TSAs are described and claimed without dependence on the exact mechanism by which they operate.

Figure 4A:
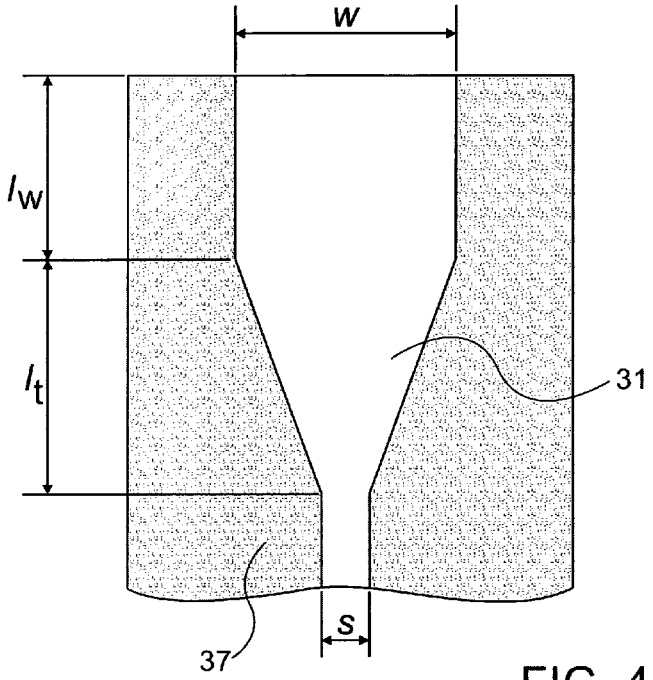
FIGS. 4A and 4B show schematically the geometrical shape and proportions of the slotted sections of the TSA of FIG. 3.
Figure 4B:
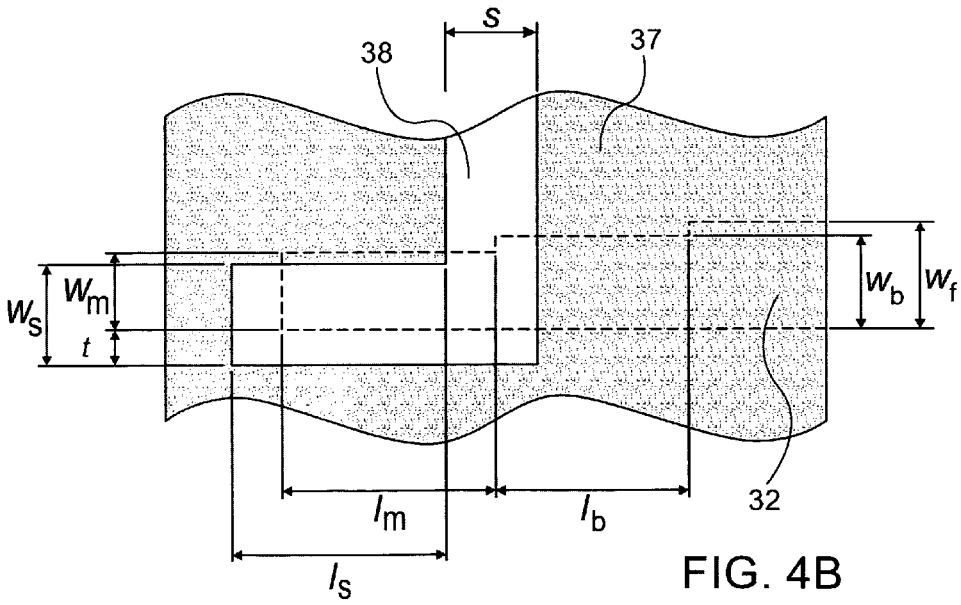

Further specific geometrical constructional details of this exemplary implementation of the TSA are now given, in order to correlate to the performance results given hereinbelow. Reference is made to FIGS. 4A and 4B, which show schematically the geometrical shape and proportions of the slotted sections of one exemplary implementation of such a TSA. FIG. 4A shows the radiating tapered slot itself, while FIG. 4B shows, on an enlarged scale to increase the clarity of the detail, the MST region and its associated lines.

The slot includes three sections:

(i) a short tapered slot section, with a tapered part of length $l_t$ and a constant-width part of length $l_w$, and width w, and (ii) a narrow-width feeding slot of width s; both of the above being shown in FIG. 4A, and (iii) a shorted-end tuning slot stub section of length $l_s$ and width $w_s$, shown in FIG. 4B.

The feed system of this example consists of three segments:

(i) a conventional 50Ω feed line segment (0.25 mm strip width);

(ii) a matching segment of length $l_b$ and width $w_b$; and (iii) an open-end tuning microstrip stub segment of length $l_m$, and width $w_m$.

It is to be understood, however, that the particular taper geometry shown in FIG. 4A, is not intended to limit the claimed invention, but that it is only one exemplary implementation. The TSAs of this application could equally well be constructed as a completely Linear Tapered Slot Antenna (LTSA), an Exponentially Tapered Slot Antenna (Vivaldi), or a Constant Width Slot Antenna (CWSA), or any other geometry as is known in the art.

Figure 5:
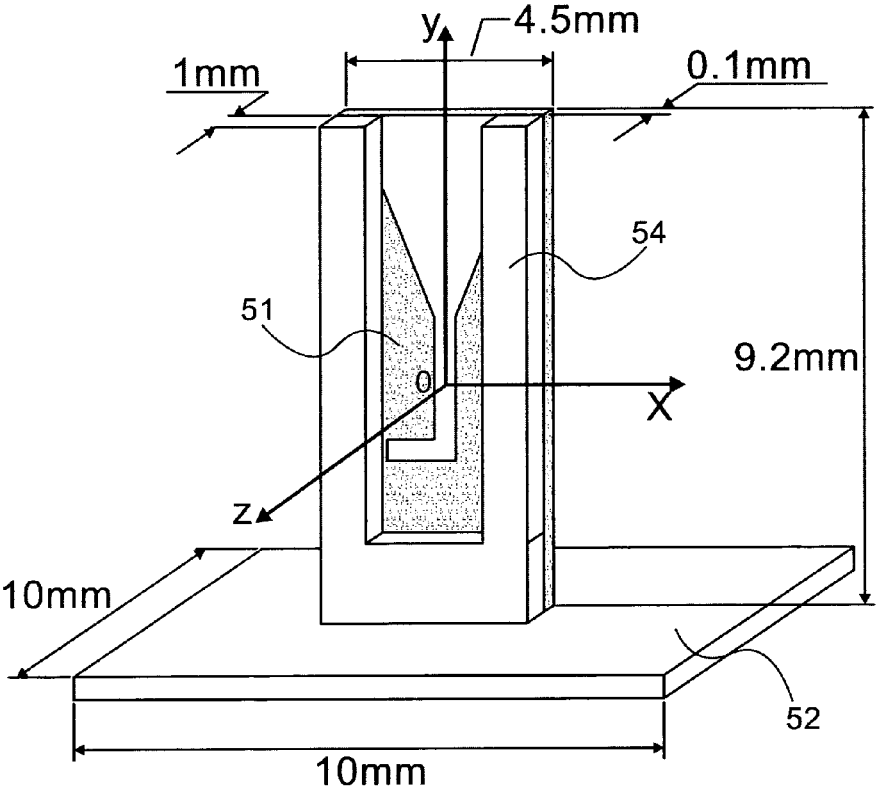
FIG. 5 illustrates constructional details of an exemplary TSA implementation, showing the mounting of the TSA element on its carrier and connection to a reflector.

Reference is now made to FIG. 5, which illustrates constructional details of one exemplary implementation, showing the mounting of the TSA element 51 on its carrier 54. The dimensions shown are typically those for a TSA for use in the 60 GHz band. The carrier 54 can advantageously be fork-shaped and metallic, providing the antenna with good mechanical rigidity, as well as a means for connecting the antenna to the RF module (not shown in FIG. 5). The support rigidity provided by the fork geometry is important when a thin flexible substrate, such as an LCP substrate is used. The fork shape does not interfere with the fields within the antenna structure. In addition, such a carrier can serve as a support for mounting a metallic reflector 52, which not only can improve the antenna directive gain, but can also reduce any possible effects of other parts of the RF module on the antenna.

EXAMPLE

Design of an exemplary antenna was carried out in three stages by use of the CST Microwave Studio Suite, available from CST AG, of Darmstadt, Germany. In the first stage, the antenna was considered without the carrier and reflector. The initial topology and dimensions of the slot chosen were similar to those of the compact linear-tapered slot antenna (LTSA) described in "Linear tapered cavity-backed slot antenna for millimeter-wave LTCC modules" by I. K. Kim et al, published in IEEE Antennas Wireless Propag. Lett., Vol. 5, pp. 175-178, 2006. Specifically, a feeding slot of width s=0.2 mm was used, and a linearly tapered slot of length $l_t$=4 mm and aperture of width w=2.5 mm.

Unlike the prior art designs, with their simple cross-over transition region, the novel microstrip-to-slot transition topology described in this disclosure, was used, with the microstrip and slot stubs laid collinearly, partially overlapping each other, as shown in FIGS. 3A and 4A-4B. The dimensions of the various elements of the TSA were then optimized in order to improve the bandwidth. In the second stage, the antenna with the dimensions found during the first stage was considered with a fork-shaped metallic carrier connected to the antenna ground plane and surrounding the slot-transition system. The final optimal dimensions of the carrier for this particular example are found to be 9.2 mm in length, 4.5 mm in width, and 1 mm in thickness. The dimensions of both stubs were slightly modified to maintain the matching close to that achieved earlier. A negligible modification of some of the antenna dimensions was needed in the third stage, when a square reflector, 10 mm×10 mm in size was connected to the carrier.

The resulting dimensions of the slot and transition were found, after the optimization process, to be $l_t$=3.4 mm, $l_w$=1.9 mm, w=2.35 mm, l=1.5 mm, s=0.16 mm, $l_s$=0.67 mm, $w_s$=0.23 mm, $l_b$=0.8 mm, $w_b$=0.2 mm, $l_m$=0.6 mm, $w_m$=0.15 mm, and t=0.04 mm. It is to be emphasized that using this novel collinear matching geometry, the area occupied by the proposed collinear microstrip-to-slot transition is very small, being only half, or even less than the area occupied by the transition used in the prior art TSA described in "A compact conformal end-fire antenna for 60 GHz applications," by L. Amadjikpe, et al, in IEEE Antennas Propag. Soc., Int. Symp. Dig., June 2009, pp. 1-4.

The matching and radiation characteristics of the thus designed antenna were simulated using CST Microwave Studio Suite. From the plot of the simulation results, shown in FIG. 6, it can be seen that the operating frequency band of the antenna, where $|S_{11}| \leq -10$ dB, is from 53.3 to 69.8 GHz, providing a greater than 25% bandwidth. It is particularly noteworthy that the antenna exhibits an even better impedance match with $|S_{11}| \leq -15$ dB in the 57-66 GHz frequency range allocated for WPAN applications.

Figure 6A:
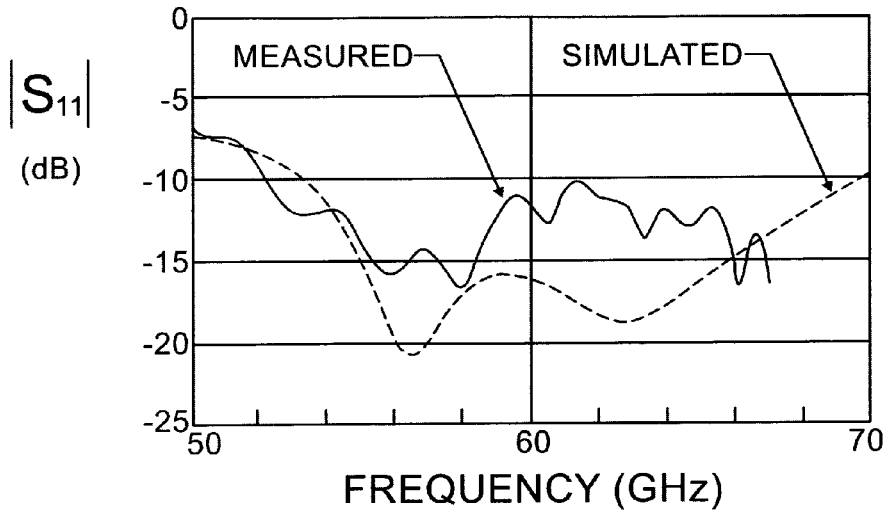
Figure 6B:
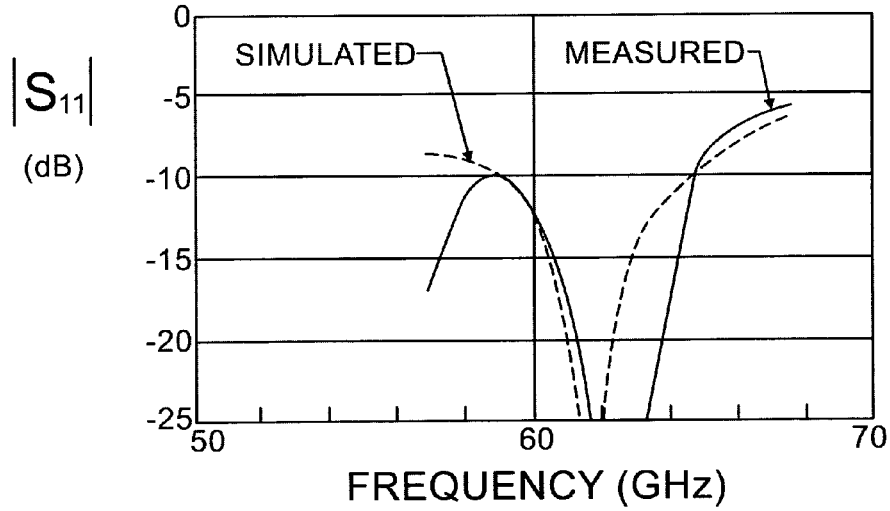
FIG. 6B shows the response characteristics of a prior art TSA antenna for comparison.
Figure 7A:
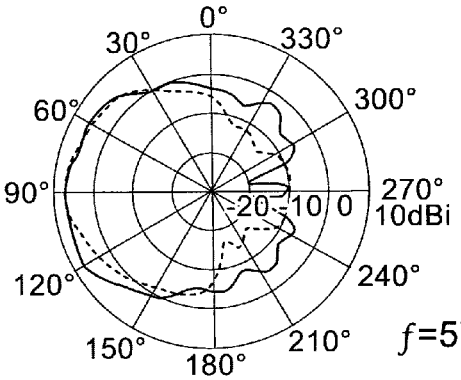
FIGS. 7A to 7D illustrate the radiation patterns of a TSA in the xy (E) and in the yz (H) planes.
Figure 7B:
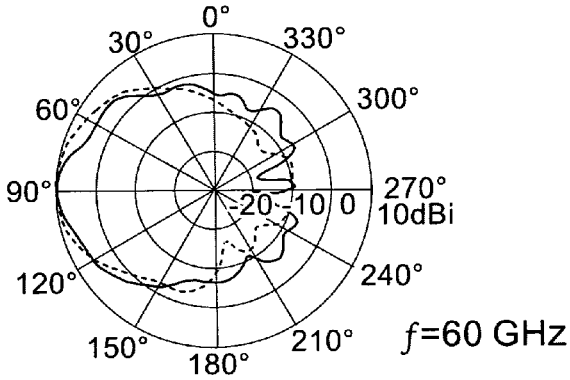
Figure 7C:
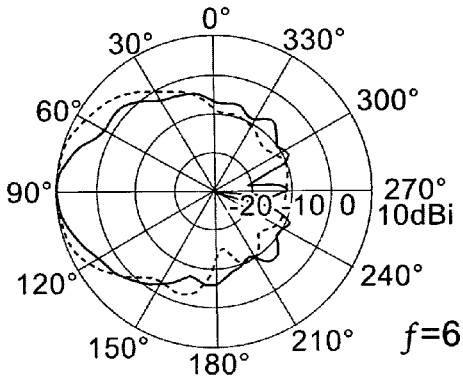
Figure 7D:
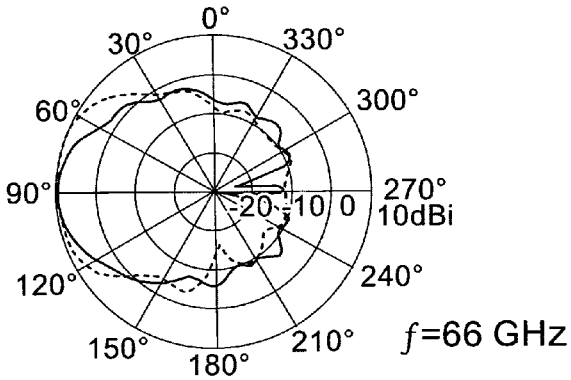

Reference is now made to FIG. 6B, for comparison purposes with the response characteristic shown in FIG. 6A. FIG. 6B shows the simulated and measured return loss curves, plotted on the same scale as that of FIG. 6A, of the prior art TSA described in FIG. 3 of the above mentioned article "A compact conformal end-fire antenna for 60 GHz applications," by L. Amadjikpe et al. As is observed, the TSA of the present application has a significantly broader response characteristic than that of the prior art shown.

The simulated radiation patterns of the antenna in the xy (E) and in the yz (H) planes are shown in FIGS. 7(*a*) to 7(*d*) for the dominant component ($E_\phi$) of the radiated electric field. As can be deduced from the graphs, the antenna 3 dB beamwidth in the E-plane varies in the 57-66 GHz frequency range between 35° and 89°, while in the H-plane it varies between 58° and 72°. Also, the front-to-back ratio of the radiation ranges between 17 and 22 dB. Other simulation results obtained indicate that the antenna's directive gain in this frequency range varies between 6.8 and 9.9 dB. Also obtained from the simulation results is that the antenna's radiation efficiency (the ratio between the radiated power and the sum of this radiated power plus the surface mode power) throughout this frequency range is nearly 96%, while its total efficiency, which is the product of its impedance-mismatch loss ($1-|S_{11}|^2$) and radiation efficiency, is nearly 94%.

A model of the above described simulated antenna, excluding the reflector, was fabricated, and its matching characteristics were measured. The antenna was held in place between the spring-loaded jaws on the back side of the fixed connector block of the Universal Test Fixture used, with the antenna's microstrip feed line pressed against the backwardly protruding tip of the center conductor of the connector. In this way, the wall of the fixed block also served as the reflector for the antenna. This is the way in which the measured results of $S_{11}$ shown in FIG. 6A were obtained, for plotting alongside the theoretical simulation results. The measured results are in good agreement with the simulated results, and indicate that the operation band of the actual antenna is even slightly wider than predicted. The level of $S_{11}$ is slightly higher than predicted, but nevertheless is still less than −10 dB throughout the range measured.

It is appreciated by persons skilled in the art that the present invention is not limited by what has been particularly shown and described hereinabove. Rather the scope of the present invention includes both combinations and subcombinations of various features described hereinabove as well as variations and modifications thereto which would occur to a person of skill in the art upon reading the above description and which are not in the prior art.

We claim:

1. A tapered slot antenna, comprising:

a dielectric substrate having a thin conductive layer on a first face, with a tapered slot being formed in said conductive layer, tapering from a broad end to a slotline at its narrow end; and a microstrip conductor carried on a second face of said dielectric substrate, wherein said slotline and said microstrip conductor on opposite faces of said dielectric substrate have paths which intersect over an area, said paths further overlapping over a substantial part of their length beyond said area where said paths intersect, thereby enabling coupling of energy between said microstrip conductor and said slotline at least over said further overlapping part of their length.

2. A tapered slot antenna according to claim 1, wherein said slotline continues beyond said intersection for a distance of essentially a quarter guided wavelength in said slotline of the average frequency for which said antenna is intended, and said microstrip conductor continues beyond said intersection for a distance of essentially a quarter guided wavelength in said microstrip of the average frequency for which said antenna is intended.

3. A tapered slot antenna according to claim 1, wherein said slotline is terminated by a short-circuit, and said microstrip conductor is terminated by an open circuit.

4. A tapered slot antenna according to claim 1, wherein the paths of said slotline and said microstrip conductor intersect at right angles.

5. A tapered slot antenna according to claim 4, wherein the paths of said slotline and said microstrip conductor overlap over at least a part of their length beyond said intersection by virtue of a right angle bend in the path of said slotline.

6. A tapered slot antenna according to claim 4, wherein the paths of said slotline and said microstrip conductor overlap over at least a part of their length beyond said intersection by virtue of a right angle bend in the path of said microstrip conductor.

7. A tapered slot antenna according to claim 1, wherein said dielectric substrate comprises a liquid crystal polymer material.

8. A tapered slot antenna according claim 1, wherein said dielectric substrate is carried on a fork-shaped carrier, providing rigidity to said antenna.

9. A tapered slot antenna according to claim 1, further comprising a metallic reflector mounted perpendicular to said dielectric substrate at an end opposite to that of said broad end of said tapered slot.

10. A tapered slot antenna according to claim 1, wherein said microstrip conductor is adapted to couple a signal port to said antenna.

11. A tapered slot antenna, comprising:

a dielectric substrate having a thin conductor on one surface, in which a tapered slot pattern is formed as a result of the progressive widening of the slot width of a slotline; and a microstrip conductor intersecting said slotline and carried on a second face of said dielectric substrate, wherein a section of said slotline and a section of said microstrip conductor have paths on opposite sides of said dielectric substrate which overlap over a part of their length, enabling coupling of energy between said overlapping sections of said microstrip conductor and said slotline.

12. A tapered slot antenna according to claim 11, wherein said slotline continues beyond said intersection for a distance of essentially a quarter guided wavelength in said slotline of the average frequency for which said antenna is intended, and said microstrip conductor continues beyond said intersection for a distance of essentially a quarter guided wavelength in said microstrip of the average frequency for which said antenna is intended.

13. A tapered slot antenna according to claim 11, wherein said slotline is terminated by a short-circuit and said microstrip conductor is terminated by an open-circuit.

14. A tapered slot antenna according to claim 11, wherein the paths of said non-widened slotline and said microstrip conductor intersect at right angles.

15. A tapered slot antenna according to claim 14, wherein the paths of said slotline and said microstrip conductor are collinear over at least a part of their length beyond said intersection by virtue of a right angle bend in the path of said slotline.

16. A tapered slot antenna according to claim 14, wherein the paths of said slotline and said microstrip conductor are collinear over at least a part of their length beyond said intersection by virtue of a right angle bend in the path of said microstrip conductor.

17. A tapered slot antenna according to claim 11, wherein said dielectric substrate comprises a liquid crystal polymer material.

18. A tapered slot antenna according to claim 11, wherein said dielectric substrate is carried on a fork shaped carrier, providing rigidity to said antenna.

19. A tapered slot antenna according to claim 11, further comprising a metallic reflector mounted perpendicular to said dielectric substrate at an end opposite to that of said widened part of said tapered slot pattern.

20. A tapered slot antenna according to claim 11, wherein said microstrip conductor is adapted to couple a signal port to said antenna.

* * * * *